US006694896B1

(12) United States Patent
Milazzo

(10) Patent No.: US 6,694,896 B1
(45) Date of Patent: Feb. 24, 2004

(54) FOLDABLE TABLE OR DESK

(76) Inventor: Lee J. Milazzo, P.O. Box 660, St. John, IN (US) 46373

( * ) Notice: Subject to any disclaimer, the term of this patent is extended or adjusted under 35 U.S.C. 154(b) by 0 days.

(21) Appl. No.: 09/972,344

(22) Filed: Oct. 5, 2001

(51) Int. Cl.[7] ..... A47B 3/00
(52) U.S. Cl. ..... 108/115; 40/611
(58) Field of Search ..... 108/115; 40/320, 40/611, 649, 727; 312/258, 262, 223.5

(56) References Cited

U.S. PATENT DOCUMENTS

| | | | | |
|---|---|---|---|---|
| 513,080 | A | | 1/1894 | Butler |
| 1,479,766 | A | | 1/1924 | Whyman |
| 2,412,395 | A | * | 12/1946 | Goosmann |
| D152,549 | S | | 2/1949 | Link |
| 2,635,681 | A | * | 4/1953 | Hiltman et al. |
| 2,943,243 | A | | 6/1960 | Rachman et al. |
| 3,436,092 | A | * | 4/1969 | Werner |
| D214,061 | S | | 5/1969 | Solo |
| D221,668 | S | | 8/1971 | Schendel |
| 4,005,537 | A | | 2/1977 | von Camber et al. |
| 4,280,744 | A | | 7/1981 | Nakano |
| 4,617,869 | A | | 10/1986 | Denomey |
| 4,820,003 | A | | 4/1989 | Lloyd |
| 5,281,016 | A | | 1/1994 | Brague |
| 5,403,082 | A | | 4/1995 | Kramer |
| 5,800,029 | A | | 9/1998 | Robertson et al. |
| 5,803,562 | A | | 9/1998 | Jacobs et al. |
| 6,041,723 | A | * | 3/2000 | Peterson |
| D424,325 | S | | 5/2000 | Iannaccone |
| 6,095,056 | A | * | 8/2000 | Schumacher |
| 6,393,748 | B1 | | 5/2002 | Cooper |
| 6,405,660 | B2 | * | 6/2002 | Itakura et al. |

FOREIGN PATENT DOCUMENTS

| | | | |
|---|---|---|---|
| FR | 2717837 | * | 3/1994 |

* cited by examiner

*Primary Examiner*—Jose V. Chen
(74) *Attorney, Agent, or Firm*—Richard G. Kinney

(57) ABSTRACT

A foldable scorer (or like) table or desk having an A-frame wheeled base with a changeable advertizing sign panel mounted on its front and a rear worktop which is pivotally mounted for movement between a storage position adjacent the rear of the base and an operational horizontal position projecting rearward from the base at desk or table height. The worktop is supported in its operational position by a foldable leg unit mounted to its underside which pivots down to provide a floor contacting leg. A storage shelf is provided in the base and a storage compartment is provided above the shelf between the advertising panel and the folded down worktop.

6 Claims, 3 Drawing Sheets

FOLDABLE TABLE OR DESK

FIELD OF THE INVENTION

The present invention relates primarily to a scorer table or desk and similar such tables such as may be used at show booths or in stores for signing up customers for an offer.

BACKGROUND OF THE INVENTION

A scorer table is used at athletic events to provide a place for a scorer to make and keep his or her records, for his or her remotely operating a scoreboard, and at which place an announcer or broadcaster may work. The table is usually at the very edge of the court so that the scorer (and/or announcer) can see the game and as a result the table is also positioned where it may be seen by much of the crowd and, if present, television cameras. Such a table or desk serves to hold the microphone of the announcer and often holds an amplifier and scoreboard control units and other electronic and non-electric equipment needed by the users.

A sales display table or desk is most often used at a large store or mall to distribute samples, demonstrate or display products, or to sign up people waking by.

Foldable tables or desks and the like have been proposed in the past for general use, for example those depicted and described in the following U.S. Pat. Nos. 5,800,029 to Robertson, et al.issued Sep. 1, 1998; 5,803,562 to Jacobs, et al. issued Sep. 8, 1998; 5,403,082 to Kramer issued Apr. 4, 1995; 5,281,016 to Brague issued Jan. 25, 1994; 4,820,003 to Lloyd issued Apr. 11, 1989; 4,280,744 to Nakano issued Jul. 28, 1981; 2,943,243 to Rachman et al. issued Jun. 28, 1960; 1,479,766 to Whyman issued Jan. 1, 1924; and 513,080 to Butler issued Jan. 23, 1894.

Despite numerous prior approaches, there still exists a need for a foldable desk or table which is particularly adapted to the needs of the scorer and game announcer or broadcaster and helps in the promotion or sales of products or services.

SUMMARY OF THE INVENTION

A foldable table or desk constructed in accordance with the principles of the present invention comprises a generally vertical base unit with a front and rear. Mounted to the front, that is to the court facing side of the unit are means for receiving a changeable display or advertising sign panel that substantially covers the front. Mounted at the rear is a worktop or table top which is movable from a storage position adjacent the base unit to an generally horizontal operational position at about table or desk height and extending rearward from the base so a user may sit or stand behind it.

When used as a scorer's table the changeable display panel or sign is prominently displayed to many of the fans witnessing a sporting event and will often be depicted in any video broadcast of the game. This provides a potential source of advertising revenue to schools, team organizations and promoters of games. When used as a sales display table, the signage panel can aid in advertising and promoting the product or service offered.

Another feature of the present invention is the combination of an A-frame wheeled structure with a sidewall that pivots up about its top edge to form a desk or table and pivots down to close a storage space.

Other features of the invention include means for rolling the base and the folded unit about so as to aid in storing it between uses. Further, a shelf and sheltered area is provided for storing electronic and other equipment between uses for storing samples, literature and other materials. The worktop is preferably supported in its operational position by folding leg means which folds down from the bottom of the moveable work top and has frictional means for engaging with the floor to not only support the worktop but also aid in preventing the table or desk from rolling when in use.

The design of the folding desk or table of the present invention lends itself to providing an extremely rugged structure which may be used outdoors or indoors, is conveniently portable, yet provides a sturdy work area when set up. The table or desk of the present design may be lightweight and can be disassembled for ease of packing and shipping and yet is easily assembled because of its easy bolt-together design.

The invention, together with further advantages and features thereof, may best be understood by reference to the following description taken in connection with the accompanying drawings, in the several figures of which like reference numerals identify like elements.

DETAILED DESCRIPTION OF A PREFERRED EMBODIMENT

Figure 1:
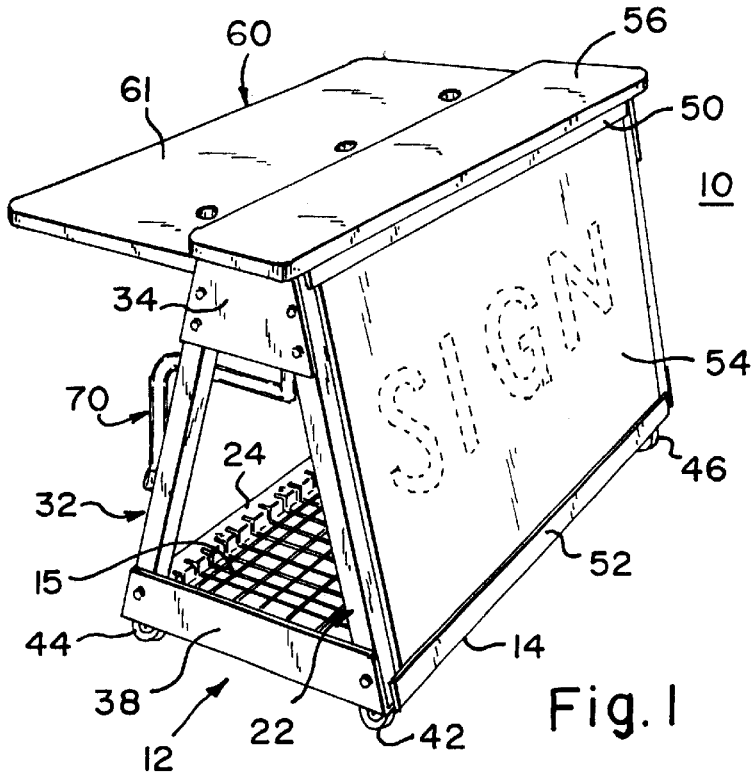
FIG. 1 is a perspective view of a foldable table or desk constructed in accordance with the principles of the present invention, which view shows the front and right side of the table or desk in its unfolded or operational configuration.
Figure 4:
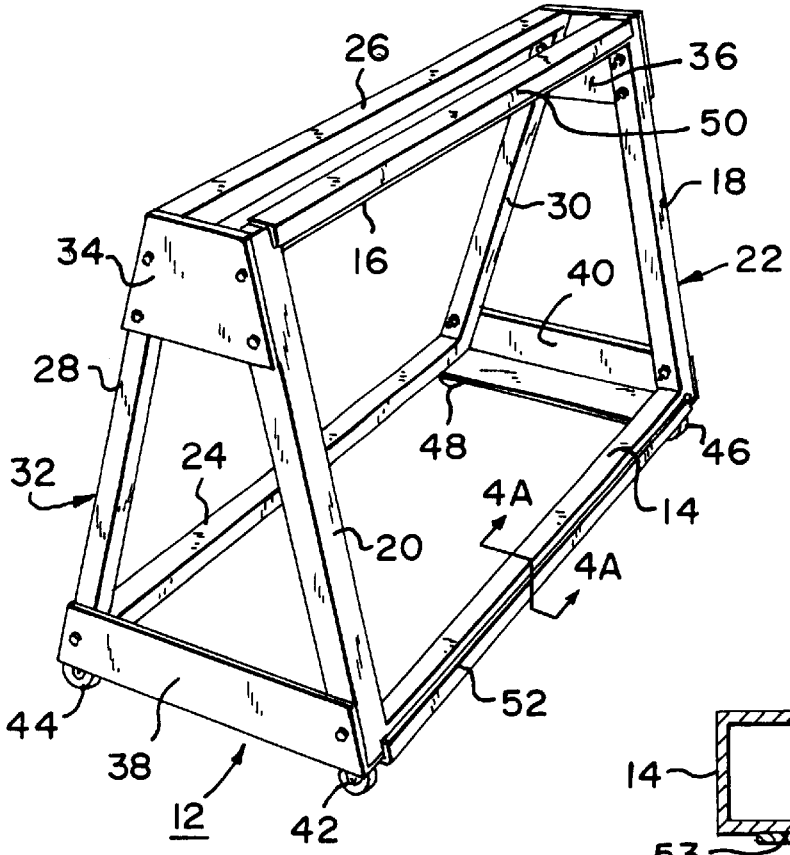
FIG. 4 is perspective view of a part of the table or desk of FIGS. 1–3, namely its base unit, which view is useful in explaining the construction of that unit.

Referring to the figures and initially to FIG. 1, there is depicted a foldable table or desk constructed in accordance with the principles of the present invention, which desk or table is generally designated by the numeral 10. The unit 10 has a base 12 of an generally A-frame construction. The base 12, as shown most clearly in FIG. 4, is made up of two rectangle frame sections 22 and 32. The front frame section 22 has a front bottom rail 14, a front top rail 16, and left and right side rails 18 and 20. All of these rails are preferably, as shown, made up of square aluminum structural tubing. The rails 14, 16, 18 and 20 are welded together at the corners of the frame section 22. The rear frame section 32 is made in the identical way with horizontal rails 24 and 26 welded to side rails 28 and 30.

The front and rear frame sections 22 and 32 are tied together by end top plates 34 and 36 and bottom angles 38 and 40. These plates 34 and 36 are bolted to the frame sections by four bolts through each top plate and two bolts through the bottom angles 38 and 40. All of these bolts pass through the sections 22 or 32 and are secured by nuts affixed at the interior of the sections 22 or 32. Four casters 42, 44, 46 and 48 are secured to the angles at the corners of the base 12 and define a rectangular area at the bottom of the base 12. It should be noted that the base tapers inward as it rises above its bottom to its top.

Means for receiving an advertisement or sign such as open tracts or slot-forming members 50 and 52 are provided. The members 50 and 52 are in the form of angles which are welded to the front top and bottom rails 14 and 16 for receiving the bottom and top portions of a rectangular sign panel 54 (FIG. 1).

The base 12 is provided with a bottom wire shelf 15 between the rails 14 and 24. This shelf can hold and store electronic equipment or other materials, both for storage and during use.

Figure 4A:
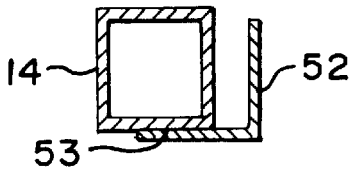
FIG. 4A is a sectional view on an enlarged scale taken from the vertical plane indicated by the line 4A—4A of FIG. 4.

FIG. 4A shows the angle member 52 and its adjacent rail 14 with the weld at 53. The angle member 52 has is generally vertical plate uniformly spaced from the adjacent surface of rail 14 by, for example, ⅜ths of an inch. This gap receives the edge of signage panel 54 which can be slid into the slots formed by the member 52 and by member 50 from the side of the base 12. Of course, other ways of securing the sign in place may be employed without departing from the broad scope of the invention.

As also shown in FIG. 1, the desk or table 10 includes a generally rectangle top cap 56 having a horizontal surface. The cap 56 is secured to the top rails 16 and 26 (FIG. 4) of the base 12. Also secured to the base 12 is a table or desk worktop member 60 which has a rectangle flat top surface 61. The worktop 60 is pivotally mounted by a piano type hinge 64 (FIG. 3) along one of its longitudinal edges 62. The hinge 64 has one leaf secured to the top rear rail 26 of the base 12 and its other leaf secured to the edge 62 of the worktop 60.

Figure 2:
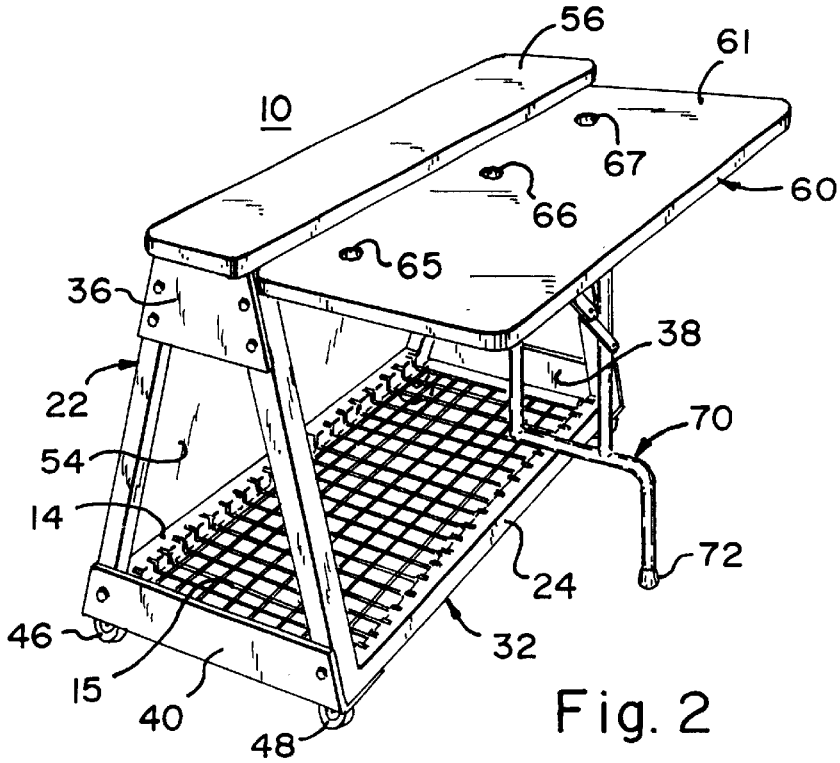
FIG. 2 is a perspective view of the table or desk of FIG. 1 showing the rear and left side of the table or desk.
Figure 3:
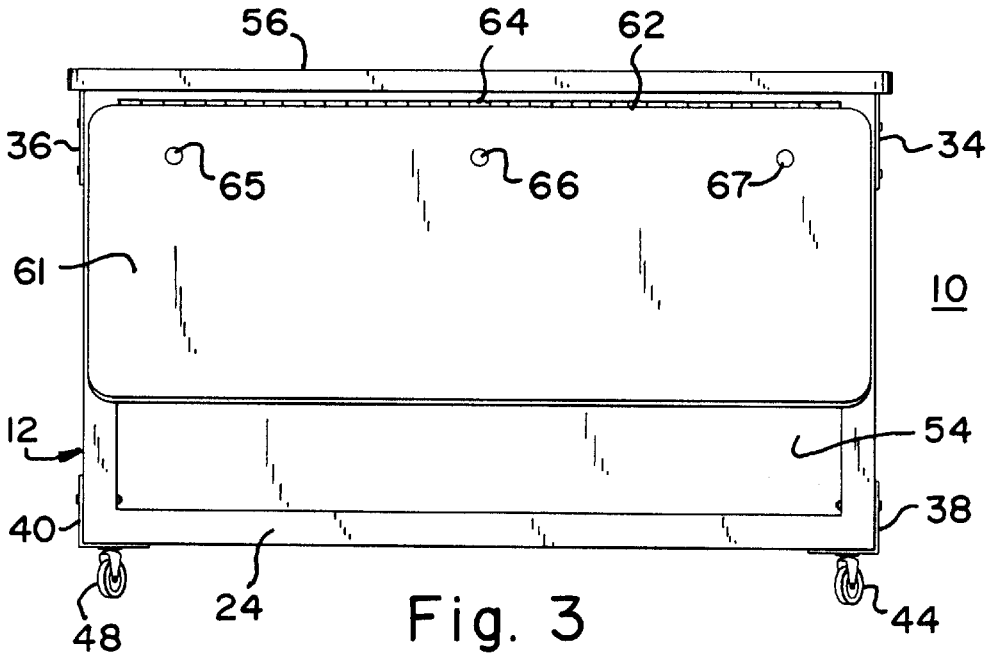
FIG. 3 is a elevational view of the desk or table of FIGS. 1 and 2 with parts, the worktop and its supporting leg, moved to their folded or storage position.
Figure 5:
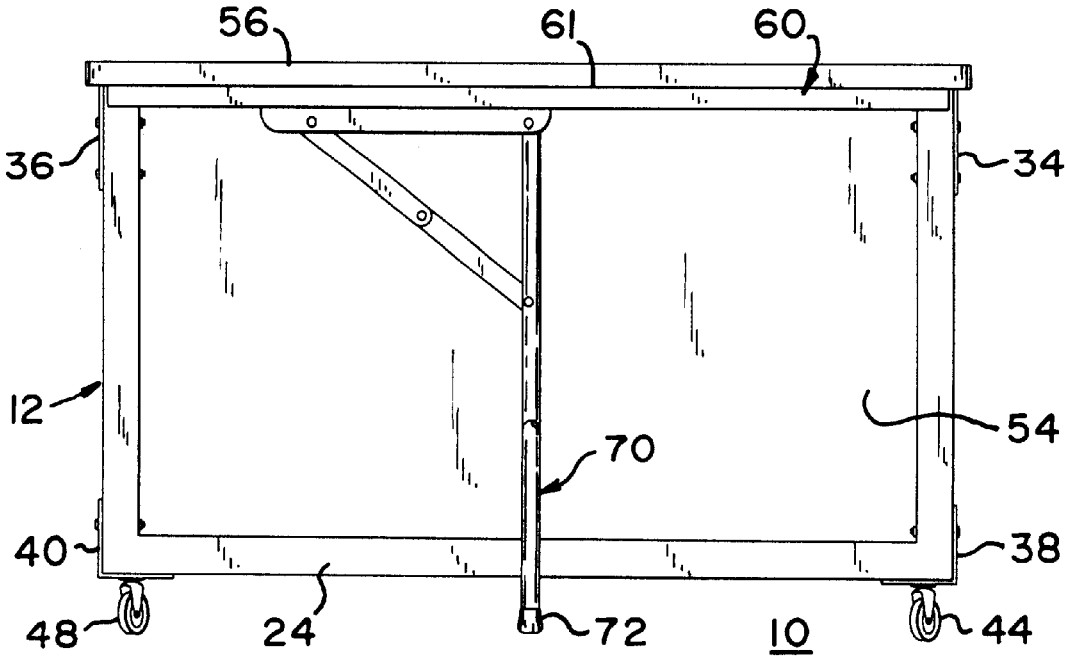
FIG. 5 is an elevational view of the rear of the desk or table of FIGS. 1–4 which desk is in it operational or unfolded configuration.
Figure 6:
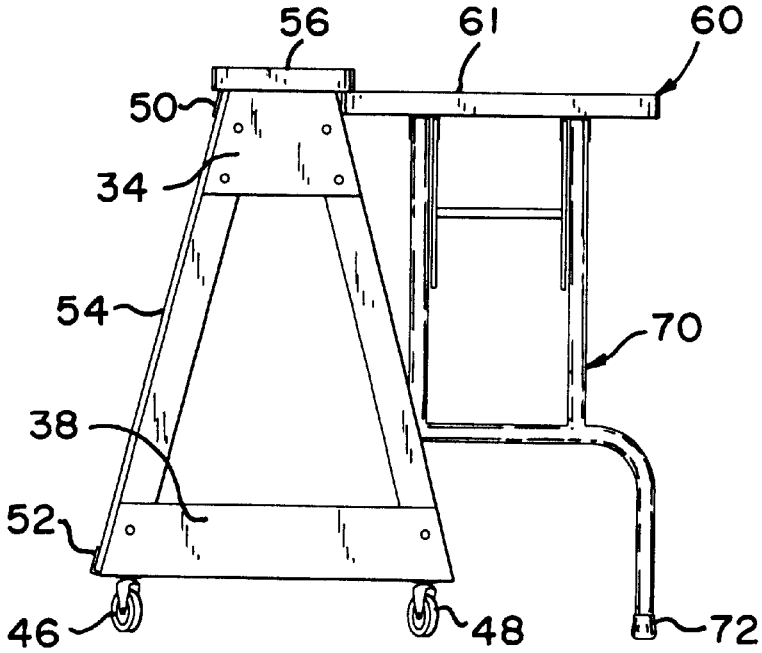
FIG. 6 is side view of the desk or table as depicted in FIG. 5.

To support the worktop 60 in its horizontal operational or unfolded position (FIGS. 1 and 2) a folding leg unit 70 is provided. The leg 70 is secured to the bottom of the worktop 60 and pivots downward from a storage position adjacent the inwardly tapering surface of the base 12 as shown in FIG. 3, to its operational position shown in FIGS. 1, 2, 5 and 6. The leg unit 70 as is best shown in FIGS. 5 and 6, is affixed to the bottom of the worktop 60 preferably by means of self drilling and tapping screws. This unit 70 may be the commercially available leg unit made by EBCO Manufacturing and distributed as its model APF-B, which in this application is modified by the removal on one of its two legs to provide a single rubber tipped leg 72. This leg 72 contacts the floor and helps hold the desk or table 10 from rolling when in use.

With the leg unit 70 folded parallel to the bottom of the worktop 60, the worktop pivots downward about the hinge 64 to its storage position adjacent the rear frame unit 32 of the base 12 as shown in FIG. 3. When so folded down, the worktop 60 helps to enclose the storage space above the shelf 15.

With the A-frame structure of the base 12, the weight of the folded-in units 60 and 70 is supported above the rectangular area whose corners are defined by the four casters 42, 44, 46, and 48. That is the center of gravity of the folded-in and compact desk or table unit 10 is within that area and as a result the folded unit 10 is stable and not subject to easily being tipped over. In this configuration, the unit 10 may be easily rolled and moved to a storage closet or to another area of use.

As is conventional the table surface 61 can be provided with holes 65, 66 and 67 for allowing cables and wires to conveniently run to the space below the tabletop.

If desired, panels (not shown) for covering the open space between the side rails 20 and 32 and between rails 18 and 30 can be provided and secured in place by velcro hook and loop fasteners. Further, standards can be affixed to each end of the base 12 to support a banner at a height of several feet above the top cap 56.

For a more secure storage within the folding table or desk 10 when in the folded or storage configuration, the optional side panels can be more securely attached and the space below the folded down worktop 60 also covered by a panel and a lock provided for locking the worktop 60 in its storage position.

Several prototypes of the inventive folding desk or table have been constructed, tested and shown to work well. One prototype which was constructed substantially as depicted and described above had an overall width of about 48 inches and a height of about 33 inches. The horizontal rails 14, 16, 24, and 26 were about 48 inches in length with the end rails 20, 22, 30 and 32 being about 28 inches in length. All of the rails were made from structural aluminum square tubing approximately 1 and ½ inches by 1 and ½ inches in cross section. The plates 34 and 36 were each made from about ¼ inch thick aluminum sheet to be 9 inches wide at their bottom and about 6 inches at their tops. The angles 38, 40 were cast aluminum and about 19 and ¾ inches wide at their bottoms and about 18 inches wide at their tops with each face of the angles being about 4 inches in height. They were approximately ¼ inches in thickness. The casters 42, 44, 46, and 48 were each three inch industrial type casters and were secured to the angles by means of 5/16 18 Threaded studs and nyloc nuts. The tracks 50 and 52 were formed from aluminum angles which were about ⅛th of an inch in thickness and had faces of 1 and ½ inches in width.

The cap 56 and worktop 60 of this prototype were each made of fiberglass and measures about 8 inches by 50 inches by one inch and 18 ½ inches by 48 inches by one inch, respectively. The weight of the entire prototype folding desk or table unit 10 was about 70 pounds.

A second prototype was constructed using a six inch riser addition bolted to the bottom of the angles 38 and 40 and an six inch extension to the leg 72. This prototype work well and provided a higher (about 39 inches) cap surface and a higher (about 38 inches) worktop surface for users who preferred to stand when using the table or desk.

A third prototype was made similarly to the first one, but was longer (approximately 72 inches) and had two spaced apart leg units such as the unit 70. This construction allows three or more people to be seated at the work station.

(Photographs of these prototypes are attached as an Exhibit to this application and made a part of it.)

The lightweight components of the unit 10 makes for a portable desk or table unit which can be easily moved between court-side and storage room. The construction is easily disassembled and reassembled so as to provide for compact shipping package. The bolt together components also allow for ease of modification, for example, for retrofitting a six inch riser under the base 12 and extending the length of the leg 72 to rise the height of the unit 10 and its work surfaces by six inches.

It should now be apparent that a new and improved folding desk or table unit has been described and depicted which provides significant advantages over prior folding tables or desks. It is relatively easy to use, fold, move, ship and store. When in its storage position its center of gravity is within the area between its wheels so as to be stable and to resist tipping. It also provides for advertizing and perhaps advertising revenue for its users, allows the advertizing message to be changed as desired. It provides storage space for electronic components or other needed materials and shelters items places on its storage shelf both during use and during storage of the folded desk or table.

While one particular embodiment of the invention has been depicted, it will be obvious to those skilled in this art that changes and modifications may be made without departing from the principles of the present invention and, therefore, the aim in the appended claims is to cover all such changes and modifications as fall within the true spirit and scope of this invention.

I claim:

1. A foldable table or desk for use on a support surface or floor comprising:

a base having a front and a rear;

means for releasable mounting sign means to the front of said base;

sign means releasable received in said mounting means, said sign means, when so received, substantially covering the front of said base and is viewable from the front of said base;

a worktop means mounted to said base and moveable from a storage position wherein said worktop means is compactly positioned with said base and an operational position wherein said worktop means is substantially horizontally disposed and extends rearward from said base; said worktop means being a generally rectangular table or desk top having a longitudinal edge and said table or desk top is mounted to said base by hinge means along said longitudinal edge of said table or desk top wherein said table or desk top is selectively held in its substantially horizontal operational position by leg means which leg means has at least one leg which is movable from a storage or folded position and an operational position wherein said one leg contacts the support surface or floor and supports said table or desk top in its operational position and said table or desk top has a bottom and said leg means is secured to the bottom of said table or desk top and said leg pivots downward to contact the support surface or floor and upwards to lie adjacent to the bottom of said table or desk top.

2. A foldable table or desk for use on a floor or surface comprising:

a base having a front, a rear and a bottom said front of said base having a front top and a front bottom;

means secured to said bottom of said base for rolling about the floor or surface said rolling means supporting said base at the periphery of said bottom of said base;

means secured at the front of said base for securing sign means;

sign means releasable received by said sign means securing means said sign means when so received substantially covering the front of said base and being viewable from the front of said base;

a generally rectangular table or desk top having a longitudinal edge mounted to said base and moveable from a storage position wherein said table or desk top is compactly positioned with said base and an operational position wherein said table or desk top is substantially horizontally disposed and extends rearward from said base said table or desk top being mounted to said base by hinge means along said longitudinal edge of said table or desk top with said longitudinal edge and hinge means being set forward from the rear of said bottom of said base; and said table or desk top being selectively held in its substantially horizontal operational position by leg means which leg means has at least one leg which is movable from a storage or folded position and an operational position wherein said one leg contacts the support surface or floor and supports said table or desk top in its operational position, said table or desk top has a bottom and said leg means is secured to the bottom of said table or desk top and said leg pivots downward to contact the support surface or floor and upwards to lie adjacent to the bottom of said table or desk top.

3. A foldable table or desk comprising:

a base having a generally A-frame construction having a rectangular bottom, an inwardly tapering rear and a horizontal member across its top;

a generally rectangular worktop pivotally secured along one longitudinal edge to said horizontal member of said base, said worktop being mounted to pivot between a storage position wherein said worktop lies adjacent the tapering rear of said base and directly above said rectangular bottom, and an operational position wherein said worktop extends horizontally rearward from said horizontal member of said base; and means for releasably securing said worktop in said operational position.

4. The foldable table or desk of claim 3, wherein said base has a horizontal shelf above said base bottom, which shelf is accessible from the rear when the worktop is in its operational position and is substantially enclosed when said worktop is in its storage position.

5. The foldable table or desk of claim 2, wherein said base has a horizontal shelf above said base bottom, which shelf is accessible from the rear when the worktop is in its operational position.

6. The foldable table or desk of claim 5, wherein said horizontal shelf is substantially enclosed when said worktop is in its storage position.

* * * * *